United States Patent [19]

Sacchetti et al.

[11] Patent Number: 4,613,057

[45] Date of Patent: Sep. 23, 1986

[54] CLOSURE

[76] Inventors: John A. Sacchetti, 2665 Pleasant Hills Rd., Hatboro, Pa. 19040; Joseph R. Tordella, 128B Elm Dr., Medford, N.J. 08055; Arthur J. Pellegrino, 353 Oxford Rd., Norristown, Pa. 19401

[21] Appl. No.: 561,387

[22] Filed: Dec. 14, 1983

[51] Int. Cl.[4] ..... B65H 3/00

[52] U.S. Cl. ..... 221/265; 221/288

[58] Field of Search ..... 221/265, 264, 263, 288, 221/266, 268, 246, 151, 152, 154, 58, 262, 186, 194; 222/370, 452, 519; 206/807, 540; 220/253

[56] References Cited

U.S. PATENT DOCUMENTS

| | | | |
|---|---|---|---|
| 2,886,209 | 5/1959 | Lermer | 222/452 |
| 3,241,712 | 3/1966 | Sacchetti et al. | 221/265 |
| 3,355,067 | 11/1967 | Espinal | 222/519 |

*Primary Examiner*—Joseph J. Rolla

*Assistant Examiner*—David H. Bollinger

[57] ABSTRACT

A closure for dispensing pills, capsules and the like includes a one-way valve member with a valved passage for opening to permit dispensing from the container when the container is in an active dispensing orientation, and for closing to prevent access to the interior of the container when the container is in an inactive non-dispensing orientation. A rotary system includes an upper cap member and a bottom member bridging the valve member, and the upper cap member has an egress passage located above the valved passage in the one-way valve member. The bottom member is keyed to rotate as a single unit with the upper cap member and includes a laterally projecting section aligned with the egress passage in the upper cap member for overlying the bottom of the valved passage in the one-way valve member when the egress passage of the upper cap member is aligned with the valved passage.

18 Claims, 11 Drawing Figures

FIG. 1
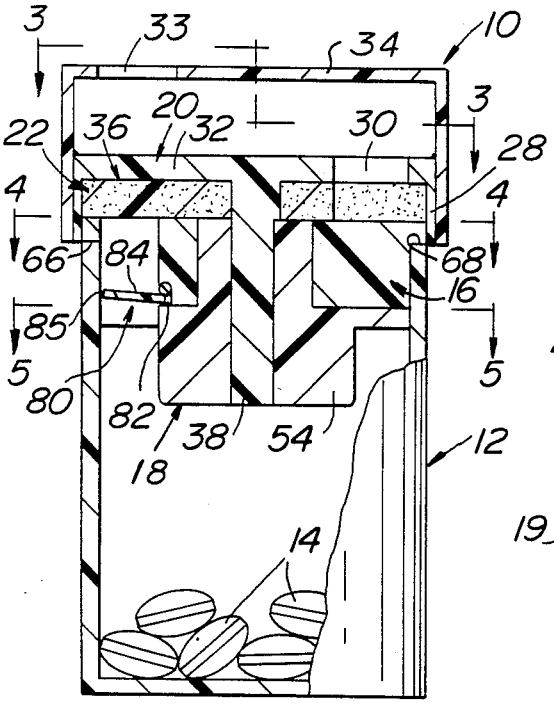
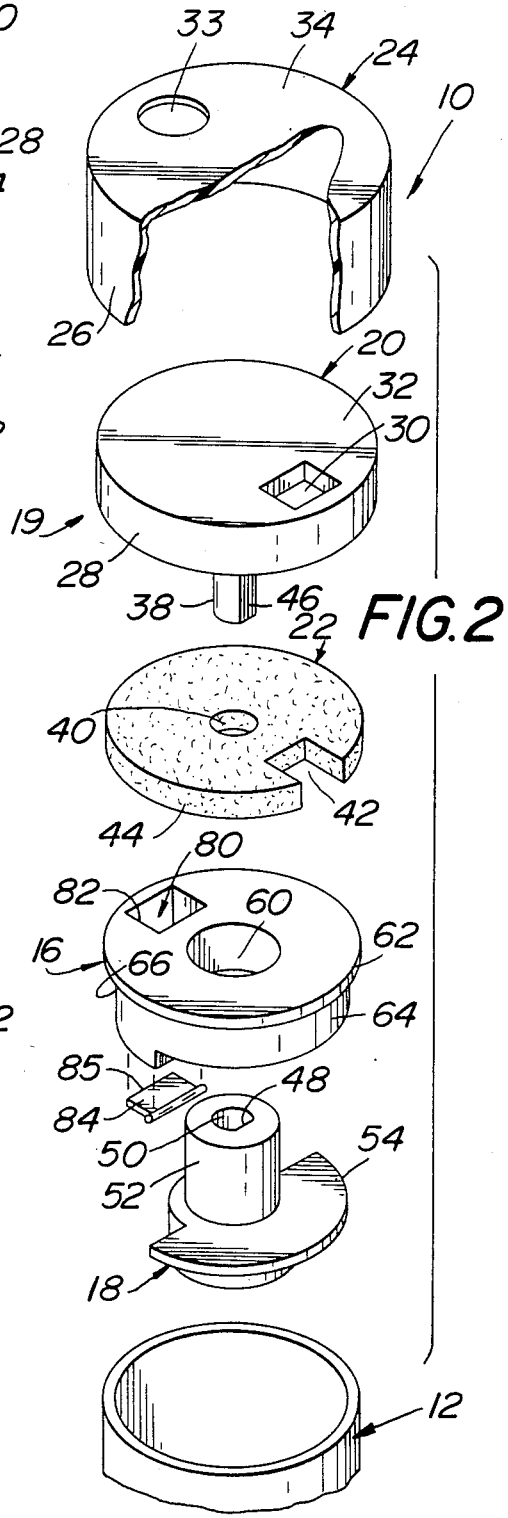
FIG. 2
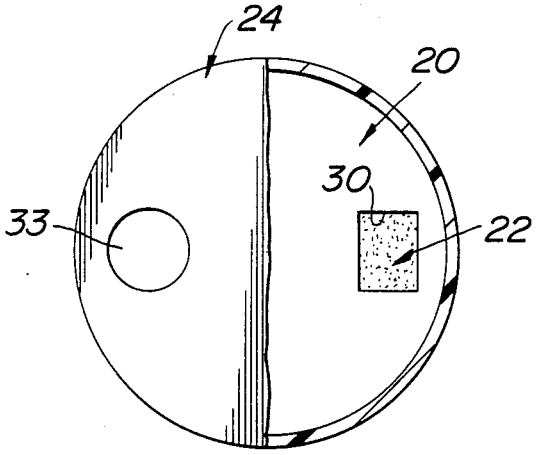
FIG. 3

FIG. 4
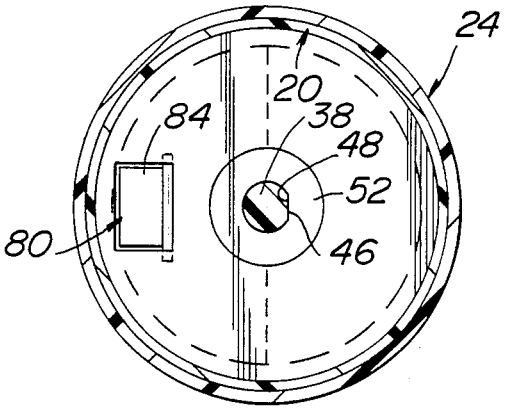
FIG. 5
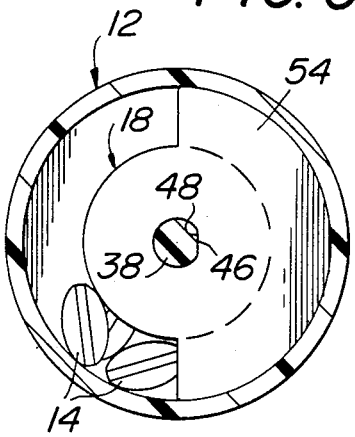
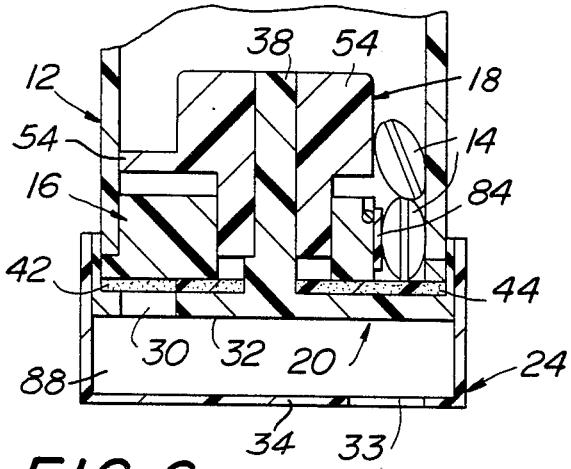
FIG. 6
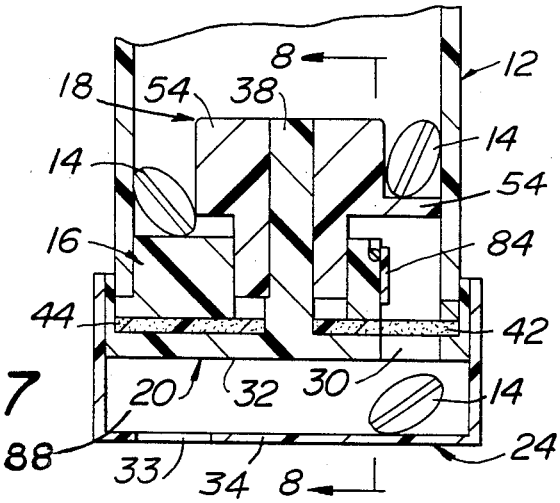
FIG. 7

FIG. 8
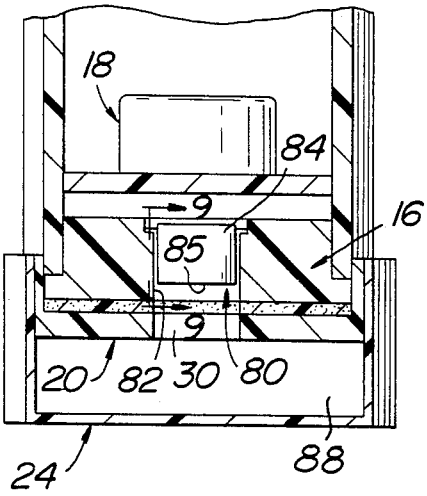
FIG. 10
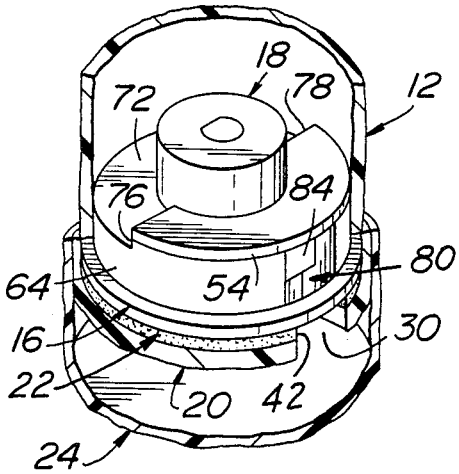
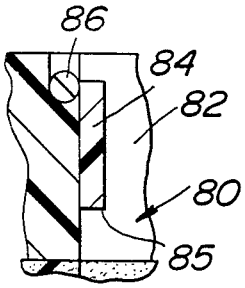
FIG. 9
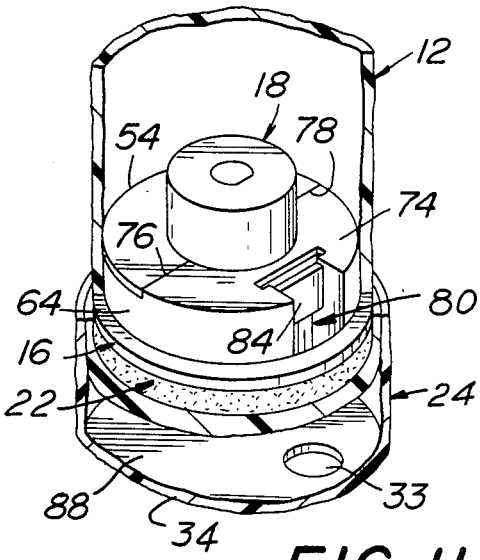
FIG. 11

CLOSURE

BACKGROUND OF THE INVENTION

This invention relates generally to closures and more specifically to closures of the type adapted to be used with a container for dispensing pills, capsules and the like.

It is well known in the art to provide bottle closures for dispensing pills one-at-a-time. One such closure is disclosed in U.S. Pat. No. 3,241,712, issued to Sacchetti et al on Mar. 22, 1966.

The Sacchetti et al closure includes a cap with a dispensing aperture adapted to be threadedly connected to a container. A spacer is positioned adjacent the underside of the cap and includes a notch in axial alignment with the dispensing aperture of the cap. The notch and dispensing aperture cooperate to provide a pill-receiving chamber, and a pill is retained in this chamber between inner and outer rotor elements that are keyed together to rotate as a single unit. The outer rotor element includes a dispenser aperture that is in a non-aligned relationship with a notch provided in the inner rotor element to permit the alternate alignment of the outer rotor element dispenser aperture and the inner rotor element notch with the pill-receiving chamber located between said rotor elements. This arrangement permits a pill to first be positioned in the pill-receiving chamber by passing through the notch of the inner rotor element when the notch is aligned with the chamber. When the notch of the inner rotor element is aligned with the pill-receiving chamber the dispenser aperture of the outer rotor element is out of alignment with said chamber to thereby prevent dispensing of the pill. However, once the pill is in the chamber the rotor elements can be rotated to bring the aperture of the outer rotor element into alignment with the chamber to dispense the pill retained in the chamber. At the same time the inner rotor element will have closed off the chamber to preclude multiple-dispensing.

While the Sacchetti et al device is capable of controlling pill dispensing it is not designed to be tamper resistant, tamper evident or child proof.

OBJECTS OF THE INVENTION

It is the general object of this invention to provide an improved closure for dispensing pills, capsules and the like that overcomes disadvantages of prior art closures.

It is a specific object of this invention to provide a tamper resistant closure for dispensing pills, capsules and the like.

It is a further object of this invention to provide a tamper evident closure for dispensing pills, capsules and the like.

It is still a further object of this invention to provide a child-proof closure for dispensing pills, capsules and the like.

It is still a further object of this invention to provide a closure that is tamper resistant, tamper evident, child-proof and that dispenses pills, capsules and the like one-at-a-time.

SUMMARY OF THE INVENTION

A closure for dispensing pills, capsules and the like includes a one-way valve member for enclosing a container. The valve member includes a valved passage means through a wall thereof for opening to permit dispensing from the container when the container is in an active dispensing orientation, and for closing to prevent access to the interior of the container when the container is in an inactive non-dispensing orientation. A rotary system for assisting in the dispensing operation includes an upper cap member and a bottom member. The upper cap member has a wall with an egress passage through it, and this wall is positioned above the wall of the valve member through which the valved passage extends. The bottom member is located beneath the wall through which the valved passage extends and is keyed to rotate as a single unit with the upper cap member. The bottom member also includes a laterally projecting section aligned with the egress passage in the upper cap member for overlying the bottom of the valved passage in the one-way valve member when the egress passage of the upper cap member is aligned with said valved passage. This will permit dispensing of the pills, capsules, etc., retained in the valved passage at the time that the egress passage of the upper cap member is brought into axial alignment with said valved passage.

Other objects and many of the attendant advantages of this invention will be readily appreciated as the same becomes better understood by reference to the following detailed description when considered in connection with the accompanying drawings.

DESCRIPTION OF THE DRAWING

FIG. 1 is a side elevational view of the closure of this invention attached to a pill container, with parts broken away to show details of construction;

FIG. 2 is an exploded isometric view more clearly illustrating the various members of the closure of this invention;

FIG. 3 is a sectional view taken along line 3—3 of FIG. 1;

FIG. 4 is a sectional view taken along line 4—4 of FIG. 1;

FIG. 5 is a sectional view taken along line 5—5 of FIG. 1;

FIG. 6 is a sectional view of the closure in an inverted and closed condition but pressed inwardly toward the container preparatory to rotating it to an opened position.

FIG. 7 is a sectional view similar to FIG. 6, but showing the closure after it has been rotated to its opened position for dispensing a single pill;

FIG. 8 is a sectional view taken along line 8—8 of FIG. 7;

FIG. 9 is a fragmentary sectional view taken along line 9—9 of FIG. 8;

FIG. 10 is an isometric view of the closure in an opened position for dispensing a pill, with parts broken away to show details of construction; and FIG. 11 is an isometric view of the closure in a closed position with parts broken away to show details of construction.

DESCRIPTION OF THE PREFERRED EMBODIMENT OF THE INVENTION

Referring now in greater detail to the various figures of the drawings wherein like reference characters refer to like parts, a closure embodying the present invention is generally shown at 10 in FIG. 1. The closure 10 basically comprises a one-way valve member 16 through which pills, capsules and the like are dispensed, one-at-a-time, by selective actuation of a rotary system of the closure that includes a top section 19 and a bottom member 18. Although the closure 10 can be utilized in connection with the dispensing of a multitude of different items, it will be described herein in connection with the dispensing of pills 14.

In the preferred embodiment of this invention the top section 19 of the rotary system includes a protective member 24 for preventing undesired access to the interior of a container 12 covered by the closure. If the protective member 24 is broken to gain access to the interior of the container 12 it will provide a visible indicator that the package has been tampered with.

In the preferred embodiment of this invention the rotary system needs to be pressed inwardly toward the container to release cooperating abutments associated with the bottom member 18 of the rotary system and the one-way valve member 16, respectively When these cooperating abutments are in engagement with each other they prevent the rotary system from being turned to dispense the contents of the container. This feature renders the closure 10 child-proof.

Referring specifically to FIGS. 1 and 2 the closure 10 of this invention is adapted to be seated on a container 12, which, in the i11ustrated embodiment contains pills 14 therein. The closure includes a one-way valve member 16 which is fixed against rotation to the container 12, most preferably by bonding said member to the container.

A rotary system bridges the member 16 to assist in the dispensing function. This rotary system includes a bottom member 18 which, as will be explained hereinafter, assists in preventing multiple dispensing of the contents within the container 12, and also assists in providing a child-proof system.

Still referring to FIGS. 1 and 2 the top section 19 of the rotary system includes an upper cap member 20, a compressible disk 22 and the protective member 24. The members forming the top section 19 are attached to each other to rotate as a single unit. In particular, the top member 24 is bonded through its peripheral wall 26 to the peripheral wall 28 of the cap member 20, and the compressible disk 22 is frictionally retained within an annular chamber 36 formed by inner surfaces of an upper wall 32 and the peripheral wall 28 of said cap member. The frictional retention of the compressible disk 22 within the annular chamber 36 is sufficient to cause the disk 22 to rotate as a single unit with said cap member.

As can be seen in FIGS. 2, 3, 6 and 7, the upper wall 32 of the cap member 20 is provided with an egress opening 30 that is offset, preferably 180°, from an egress opening 33 in the upper wall 34 of the protective member 24. Offsetting the egress opening 33 from the egress opening 30 assists in making the closure 10 tamper resistant as will be explained in greater detail hereinafter.

A stem 38 is formed integrally as part of the cap member 20 and extends downwardly through a central aperture 40 provided in the disk 22. The disk further includes a generally rectangular notch or passage 42 extending inwardly from the peripheral edge 44 thereof. This notch 42 is positioned in axial alignment with the egress opening 30 in the cap member 20 so that a pill 14 is capable of being dispensed through said egress opening in a manner to be explained in greater detail hereinafter.

Referring to FIGS. 2, 4 and 5, the elements of the top section 19 (i.e. the cap member 20, the compressible disk 22 and the protective member 24) of the rotary system are keyed to rotate as a single unit with the bottom member 18. This is accomplished through cooperation of a generally flat surface 46 on the stem 38 of the cap member 20 with a mating flat surface 48 forming part of the inner periphery of a passage 50 provided in a hub 52 of the bottom member 18.

As can be seen best in FIGS. 2 and 5 the bottom member 18 includes a laterally projecting, semicircular disk-like section 54 having a radius substantially equal to the radius of cylindrical pill-containing compartment of the container 12 to which the closure 10 is to be attached. This results in close conformity being established between the peripheral surface of the section 54 and the inner peripheral side surface of the container compartment to thereby prevent pills from moving therebetween. This arrangement assists in providing one-at-a-time dispensing as will be described in greater detail hereinafter.

Referring to FIGS. 1 and 2 the one-way valve member 16 includes a central passage 60 through which the hub 52 of the bottom member 18 extends. The member 16 includes a head section 62 extending outwardly beyond an annular base section 64 to thereby define an annular, downwardly facing shoulder 66 adapted to seat on the upper edge 68 of the container 12 (FIG. 1). In a preferred embodiment of this invention the downwardly facing shoulder 66 actually is bonded to the upper edge 68 of the container 12 to prevent removal of the closure from the container. This further assists in providing a tamper resistant construction.

As can be seen best in FIGS. 2, 10 and 11 the lower surface of the annular base section 64 of member 16 has a semicircular recessed region 72 defining, at its junction with semicircular unrecessed region 74, a substantially linear abutment shoulder 76. This abutment shoulder is adapted to engage linear surface 78 of the semicircular disk-like section 54 of the bottom member 18 to thereby releasably "lock" the closure 10 in a closed position, as will be described in greater detail in connection with the preferred operation of the closure of this invention.

Referring specifically to FIGS. 1, 2, 8 and 9 the one-way valve member 16 includes a one-way valved passage 80 provided by a passageway 82 adapted to be closed by a door or flap 84 rotatably supported by an axle 86. It should be noted that the passageway 82 is substantially rectangular, and that the depth of the flap between its forward free edge 85 and the axle 86 is greater than the corresponding demension of the passageway 82. The flap 84 is positioned in the passageway 82 such that it normally is slightly upwardly inclined, as viewed in FIG. 1, with its free edge 85 engaging any adjacent edge of the passageway 82. This prevents the flap 84 from pivoting in a downward direction, as viewed in FIG. 1. Stating this another way, the flap 84 can only pivot in one direction, and that direction is the one necessary for dispensing pills 14 out of the container 12. Thus the arrangement of the flap 84 within the passageway 82 provides a one-way valve function, wherein the flap 84 is free to rotate only in a direction for dispensing pills from the container.

In the illustrated embodiment the flap 84 rotates to open the passageway 82 when the closure 10 is inverted, as can be seen best in FIGS. 6, 7 and 9. When the container 12 is positioned in its normally upright position as shown in FIG. 1, the flap 84 will move into a general horizontal, but slightly upwardly inclined position sealing off the passageway 82. Due to the relationship between the depth of the flap 84 and the corresponding dimension of the passageway 82 the flap is not permitted to pivot downwardly, as shown in FIG. 1, into a position that would open the passageway 82 to the contents of the container 12.

The operation of the closure 10 of this invention, will now be described.

OPERATION

When a container of pills is packaged the closure 10 of this invention is maintained in a closed condition. That is, the closure is arranged so that it is not capable of dispensing a pill merely by inverting the container into its active dispensing orientation.

Referring to FIGS. 1, 6 and 11, when the closure 10 is in a closed condition the egress opening 30 in the cap member 20 and its aligned notch 42 in the compressible disk 22 are positioned out of alignment with the valved passage 80 in the one-way valve member 16. Moreover the linear surface 78 of the semicircular, laterally projecting disk-like section 54 of the bottom member 18 is in engagement with the linear abutment shoulder 76 forming a part of the annular base 64 of the one-way valve member 16.

With the surface 78 engaging the abutment shoulder 76 the cap member 20 cannot be rotated relative to the one-way valve member 16 to align the egress opening 30 in the cap member and the notch 42 in the compressible disk 22 with the valved passage 80. Thus, the cap member cannot simply be rotated to open the closure, and this impediment to rotation makes the closure child-proof. As is clearly shown in FIG. 6 the pills 14 cannot be dispensed with the closure 10 in its closed position.

In summary, the engagement of the linear surface 78 of the bottom member 18 with the abutment shoulder 76 of the one-way valve member 16, accompanied by the keyed connection of the cap member 20 to the bottom member 18 prevents rotation of the cap member 20 relative to the one-way valve member 16 by the simple action of attempting to rotate said cap member.

To rotate the cap member 20 relative to the one-way valve member 16 for the purpose of aligning the egress opening 30 of the cap member with the valved passage 80 in the member 16 it first is necessary to push the cap member 20 axially inwardly toward the container 12 (i.e. downwardly, as viewed in FIG. 1 or upwardly as viewed in FIG. 6) against the resistive force provided by the compressible disk 22. This inward movement of the cap member likewise moves the bottom member 18 inwardly to thereby axially move the linear surface 78 of the bottom member 18 out of engagement with the abutment shoulder 76 of the one-way valve member 16, as is shown in FIG. 6. In this compressed condition the cap member 20 can be rotated to position its egress opening 30 in axial alignment with the valved passage 80 as shown in FIG. 7. When this rotational movement of the cap member 20 is effected with the container 12 in an inverted, or active dispensing orientation a pill 14 located in the valved passage 80 will be dispensed into a compartment 88 provided between the upper wall 32 of the cap member 20 and the upper wall 34 of the protective member 24.

Referring to FIGS. 7 and 10 it should be apparent that the semicircular lateral section 54 of the bottom member 18 moves into overlying relationship with the valved passage 80 at the same time that the egress opening 30 in the cap member 20 moves into alignment with said valved passage. Accordingly, a pill retained in the valved passage 80 will be dispensed through the egress 30; however, the remaining pills in the container 12 will not be permitted access to said passage. Thus, the provision of the semicircular lateral section 54 relative to the top section 19 of the rotary system assists in providing one-at-a-time pill dispensing.

After a pill 14 has been dispensed, as illustrated in FIG. 7, the container merely needs to be tilted at a slight angle to cause the pill to move through the compartment 88 and out the egress opening 33 of the protective member 24.

By positioning the egress opening 33 180° out of phase from the egress opening 30 individuals are denied access to the valved passage 80 even when the egress opening 30 in the cap member is aligned with said valved passage. In order for an individual to gain access to the valved passage 80 it is necessary for him (or her) to actually break the protective member 24. This clearly will provide a visible indication that the package has been tampered with; thereby warning consumers that the package should not be purchased.

In summary it should be apparent that the closure 10 of this invention is a tamper resistant system which, if tampered with, provides a visible indication warning against purchase of the item.

Moreover, the closure is designed to be child-proof; requiring significant manual dexterity by a child to operate it to dispense a pill. In particular, to open the container 10 and dispense a pill 14 the child has to compress the top section 19 of the rotary system toward the container and then rotate the top section while maintaining it compressed, all with the container 12 in an inverted orientation as shown in FIGS. 6 and 7. If a child inadvertently compresses and rotates the top section 19 of the rotary system to bring the egress opening 30 of the cap member 20 into alignment with the valved passage 80 of the member 16 with the container in an upright or inactive dispensing orientation, as shown in FIG. 1, no pill can be dispensed, even if the container is then inverted. To further explain, if the container 12 is in an upright position when the top section 19 of the rotary system is turned to open the closure 10 there will be no pill in the valved passage 80 to be dispensed. Furthermore, the laterally extending section 54 of the bottom member 18 will be positioned over the valved passage 80 to prevent a pill from moving into the passage even if the package then is inverted.

Without further elaboration, the foregoing will so fully illustrate my invention that others may, by applying current or future knowledge, readily adopt the same for use under various conditions of service.

I claim:

1. A closure usable with a container for dispensing pills, capsules and the like, said closure being characterized by a one-way valve member for enclosing the container, and a rotary system for assisting in the dispensing operation, said valve member including a valved passage means through a wall thereof and means for opening said valved passage means to permit dispensing from the container when said container is in an active dispensing orientation and for closing said valved passage means to prevent access to the container when said container is in an inactive non-dispensing orientation in any rotary position of the rotary system, said rotary system including an upper cap member and a bottom member, said upper cap member including a wall positioned above the wall of the one-way valve member through which the valved passage extends and including an egress passage therethrough, said bottom member being located beneath the wall through which the valved passage extends and being keyed to rotate with the upper cap member, said bottom member including a laterally projecting section aligned with the egress passage in the upper cap member for overlying the bottom of the valved passage when the egress passage of the upper cap member is aligned with the valved passage of the one-way valve member.

2. The closure of claim 1 characterized by a protective member fixed to the upper cap member and adapted to rotate as a unit with said upper cap member and bottom member, said protective member including an upper wall overlying the wall of the cap member through which the egress passage of the cap member extends, said protective member including an egress opening out of alignment with the egress opening through the cap member to prevent access to the egress opening through the cap member.

3. The closure of claim 2 characterized in that the upper cap member and the bottom member are keyed to move axially as a unit relative to the one-way valve member, said one-way valve member and bottom member including cooperating surfaces adapted to engage each other for preventing relative rotation between the one-way valve member and the rotary system when the upper cap member and bottom member are in a first axial position relative to the one-way valve member, and for disengaging to permit relative rotation between the one-way valve member and the rotary system when the upper cap member and bottom member are in a second axial position relative to said one-way valve member and compressible means for normally biasing the upper cap member and bottom member into said first axial position.

4. The closure of claim 3 characterized in that the compressible means includes a compressible disk disposed between the upper cap member and the one-way valve member and being secured to rotate with the upper cap member, said compressible disk including a passage in the region aligned with the egress passage through the cap member.

5. The closure of claim 1 characterized in that the upper cap member and the bottom member are keyed to move axially as a unit relative to the one-way valve member, said one-way valve member and bottom member including cooperating surfaces adapted to engage each other for preventing relative rotation between the one-way valve member and the rotary system when the upper cap member and bottom member are in a first axial position relative to the one-way valve member, and for disengaging to permit relative rotation between the one-way valve member and the rotary system when the upper cap member and bottom member are in a second axial position relative to said one-way valve member and compressible means for normally biasing the upper cap member and bottom member into said first axial position.

6. The closure of claim 5 characterized in that said compressible means includes a compressible disk disposed between the upper cap member and the one-way valve member and being secured to rotate with the upper cap member, said compressible disk including a passage in the region aligned with the egress passage through the cap member.

7. The closure of claim 1 characterized in that the upper cap member includes a downwardly directed post for engaging an axially aligned passage provided in a hub of the bottom member, said post and passage having cooperating surfaces for keying the upper cap member and bottom member together so that they will rotate as a single unit.

8. The closure of claim 1 characterized in that the valved passage includes an opening extending through an upper wall of the one-way valve member and a rotatable flap dimensioned so that it can only rotate to open the passage when the container is tilted into an active dispensing orientation.

9. The closure of claim 8 characterized by a protective member fixed to the upper cap member and adapted to rotate as a unit with said upper cap member and bottom member, said protective member including an upper wall overlying the wall of the cap member through which the egress passage of the cap member extends, said protective member including an egress opening out of alignment with the egress opening through the cap member to prevent access to the egress opening through the cap member.

10. The closure of claim 9 characterized in that the upper cap member and the bottom member are keyed to move axially as a unit relative to the one-way valve member, said one-way valve member and bottom member including cooperating surfaces adapted to engage each other for preventing relative rotation between the one-way valve member and the rotary system when the upper cap member and bottom member are in a first axial position relative to the one-way valve member, and for disengaging to permit relative rotation between the one-way valve member and the rotary system when the upper cap member and bottom member are in a second axial position relative to said one-way valve member and compressible means for normally biasing the upper cap member and bottom member into said first axial position.

11. The closure of claim 10 characterized in that the compressible means includes a compressible disk disposed between the upper cap member and the one-way valve member and being secured to rotate with the upper cap member, said compressible disk including a passage in the region aligned with the egress passage through the cap member.

12. A closure usable with a container for dispensing pills, capsules and the like, said closure being characterized by a one-way valve member for enclosing the container, said valve member including a valved passage means through a wall thereof for opening to permit dispensing from the container when said container is in an active dispensing orientation and for closing to prevent access to the container when said container is in an inactive non-dispensing orientation, a rotary system for assisting in the dispensing operation, said rotary system including an upper cap member and a bottom member, said upper cap member including a wall positioned above the wall of the one-way valve member through which the valved passage extends and including an egress passage therethrough, said bottom member being located beneath the wall through which the valved passage extends and being keyed to rotate with the upper cap member, said bottom member including a laterally projecting section aligned with the egress passage in the upper cap member for overlying the bottom of the valved passage when the egress passage of the upper cap member is aligned with the valved passage of the one-way valve member, said upper cap member and said bottom member being keyed to move axially as a unit relative to the one-way valve member, said one-way valve member and bottom member including cooperating surfaces adapted to engage each other for preventing relative rotation between the one-way valve member and the rotary system when the upper cap member and bottom member are in a first axial position relative to the one-way valve member, and for disengaging to permit relative rotation between the one-way valve member and the rotary system when the upper cap member and bottom member are in a second axial position relative to said one-way valve member and compressible means for normally biasing the upper cap member and bottom member into said first axial position.

13. The closure of claim 12 characterized by a protective member fixed to the upper cap member and adapted to rotate as a unit with said upper cap member and bottom member, said protective member including an upper wall overlying the wall of the cap member through which the egress passage of the cap member extends, said protective member including an egress opening out of alignment with the egress opening through the cap member to prevent access to the egress opening through the cap member.

14. The closure of claim 13 characterized in that the compressible means includes a compressible disk disposed between the upper cap member and the one-way valve member and being secured to rotate with the upper cap member, said compressible disk including a passage in the region aligned with the egress passage through the cap member.

15. A closure usable with a container for dispensing pills, capsules and the like, said closure being characterized by a one-way valve member for enclosing the container, a valved passage in said member, said valved passage including an opening extending through an upper wall of said one-way valve member and a rotatable flap dimensioned so that it can only rotate to open the passage when the container is tilted into an active dispensing orientation, a rotary system for assisting in the dispensing operation, said rotary system including an upper cap member and a bottom member, said upper cap member including a wall positioned above the wall of the one-way valve member through which the valved passage extends and including an egress passage therethrough, said bottom member being located beneath the wall through which the valved passage extends and being keyed to rotate with the upper cap member, said bottom member including a laterally projecting section aligned with the egress passage in the upper cap member for overlying the bottom of the valved passage when the egress passage of the upper cap member is aligned with the valved passage of the one-way valve member.

16. The closure of claim 15 characterized by a protective member fixed to the upper cap member and adapted to rotate as a unit with said upper cap member and bottom member, said protective member including an upper wall overlying the wall of the cap member through which the egress passage of the cap member extends, said protective member including an egress opening out of alignment with the egress opening through the cap member to prevent access to the egress opening through the cap member.

17. The closure of claim 16 characterized in that the upper cap member and the bottom member are keyed to move axially as a unit relative to the one-way valve member, said one-way valve member and bottom member including cooperating surfaces adapted to engage each other for preventing relative rotation between the one-way valve member and the rotary system when the upper cap member and bottom member are in a first axial position relative to the one-way valve member, and for disengaging to permit relative rotation between the one-way valve member and the rotary system when the upper cap member and bottom member are in a second axial position relative to said one-way member and compressible means for normally biasing the upper cap member and bottom member into said first axial position.

18. The closure of claim 17 characterized in that the compressible means includes a compressible disk disposed between the upper cap member and the one-way valve member and being secured to rotate with the upper cap member, said compressible disk including a passage in the region aligned with the egress passage through the cap member.

* * * * *